US011220937B2

(12) United States Patent
Asami

(10) Patent No.: US 11,220,937 B2
(45) Date of Patent: Jan. 11, 2022

(54) OIL PAN FOR INTERNAL COMBUSTION ENGINE

(71) Applicant: HONDA MOTOR CO., LTD., Tokyo (JP)

(72) Inventor: Takashi Asami, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/205,007

(22) Filed: Mar. 18, 2021

(65) Prior Publication Data

US 2021/0301692 A1 Sep. 30, 2021

(30) Foreign Application Priority Data

Mar. 30, 2020 (JP) ..... JP2020-059862

(51) Int. Cl.
*F01M 11/00* (2006.01)

(52) U.S. Cl.
CPC . *F01M 11/0004* (2013.01); *F01M 2011/0012* (2013.01); *F01M 2011/0054* (2013.01); *F01M 2011/0091* (2013.01)

(58) Field of Classification Search
CPC ..... F01M 11/0004; F01M 2011/0054; F01M 2011/0091; F01M 2011/0012
See application file for complete search history.

(56) References Cited

U.S. PATENT DOCUMENTS

2013/0126016 A1* 5/2013 Inoue ..... F01M 11/00 137/409
2018/0313240 A1* 11/2018 Sato ..... F02B 77/13

FOREIGN PATENT DOCUMENTS

| | | | |
|---|---|---|---|
| JP | H0363746 | U | 6/1991 |
| JP | 2004353506 | A | 12/2004 |
| JP | 2008144848 | A | 6/2008 |
| JP | 2008150974 | A | 7/2008 |
| JP | 2009287436 | A | 12/2009 |
| WO | 2008072416 | A1 | 6/2008 |

OTHER PUBLICATIONS

Office Action for Patent Application JP 2020-059862 dated Jul. 27, 2021; 3 pp.

* cited by examiner

*Primary Examiner* — Syed O Hasan
(74) *Attorney, Agent, or Firm* — Armstrong Teasdale LLP

(57) ABSTRACT

An oil pan (14) for an internal combustion engine includes a bottom wall (16) provided with two downward bulges (28) extending in a crankshaft axial direction (X), and an upward bulge (30) positioned between the two downward bulges continuously to the downward bulges and extending in the crankshaft axial direction. The upward bulge has a width (Wb) as measured in a transverse direction orthogonal to the crankshaft axial direction greater than corresponding widths (Wa) of the downward bulges.

9 Claims, 4 Drawing Sheets

OIL PAN FOR INTERNAL COMBUSTION ENGINE

TECHNICAL FIELD

The present invention relates to an oil pan for an internal combustion engine.

BACKGROUND OF THE INVENTION

The internal combustion engine is typically provided with an oil pan in a lower part thereof to store lubricating oil therein. Such an oil pan is often provided with beads that project upward and downward from the general plane of the bottom wall for the purpose of reducing noises due to the vibration of the bottom wall. See JPH3-63746U, for instance.

In such a conventional oil pan, the bending rigidity of the bottom wall is improved by the beads, but the downwardly projecting beads impair the availability of the space immediately under the internal combustion engine, and unnecessarily increase the volume of the oil reservoir defined by the oil pan.

BRIEF SUMMARY OF THE INVENTION

In view of such a problem of the prior art, a primary object of the present invention is to provide an oil pan for an internal combustion engine that allows the bottom wall thereof to have an increased bending rigidity, does not impair the availability of the space immediately under the internal combustion engine, and does not unnecessarily increase the volume of the oil reservoir defined by the oil pan.

To achieve such an object, the present invention provides an oil pan (14) provided in a lower part of an internal combustion engine (10), and including a bottom wall (16), wherein the bottom wall includes two downward bulges (28) extending in a crankshaft axial direction (X), and an upward bulge (30) positioned between the two downward bulges continuously to the downward bulges and extending in the crankshaft axial direction, the upward bulge having a width (Wb) as measured in a transverse direction orthogonal to the crankshaft axial direction greater than corresponding widths (Wa) of the downward bulges.

Thereby, the bottom wall of the oil pan may have an increased bending rigidity, the availability of the space immediately under the internal combustion engine is not impaired, and an unnecessary increase in the volume of the oil reservoir defined by the oil pan can be avoided.

Preferably, the downward bulges and the upward bulge each define an arcuate shape in a section orthogonal to the crankshaft axial direction, and the upward bulge has a larger radius of curvature than the downward bulges.

Thereby, the protrusion of the upward bulge into the oil reservoir is minimized so that an unnecessary increase in the volume of the oil reservoir defined by the oil pan can be avoided in a favorable manner.

Preferably, the downward bulges and the upward bulge are defined by parts of mutually externally tangent circles in the section orthogonal to the crankshaft axial direction.

Since there is no planar portion between the downward bulges and the upward bulge, the bending rigidity of the bottom wall in the crankshaft axial direction can be effectively improved.

Preferably, the bottom wall includes a shallow bottom portion (20) located on an output shaft end thereof, an intermediate depth portion (24) located on a chain case side thereof, and a deep bottom portion (22) located between the shallow bottom portion and the intermediate depth portion along the crankshaft axial direction, the intermediate depth portion being deeper than the shallow bottom portion and shallower than the deep bottom portion, and the downward bulges and the upward bulge are provided in the intermediate depth portion.

Thereby, the bending rigidity of the intermediate depth portion in the crankshaft axial direction can be improved.

Preferably, the downward bulges and the upward bulge extend substantially over an entire length of the intermediate depth portion in the crankshaft axial direction.

Thereby, the bending rigidity of the intermediate depth portion in the crankshaft axial direction is improved over the entire length thereof in the crankshaft axial direction.

Preferably, the oil pan further comprises a transverse rib (32) extending across the downward bulges and the upward bulge at intermediate parts thereof with respect to the crankshaft axial direction, the transverse rib bulging downward of the oil pan.

Thereby, the bending rigidity of the bottom wall of the oil pan in the transverse direction or in the direction orthogonal to the crankshaft axial direction can be improved.

Preferably, the oil pan further comprises a side wall (18) extending upright from a peripheral edge of the bottom wall, and a boss (26) projecting from a junction between an outer end of the transverse rib and the side wall in the transverse direction, an outer end of the boss being configured to attach an engine component part (50).

Since the boss is positioned at the junction between the side wall and the transverse rib, the bending rigidity of the bottom wall in the transverse direction can be particularly favorably improved.

Preferably, the oil pan further comprises a side wall (18) extending upright from a peripheral edge of the bottom wall, wherein the bottom wall includes three downward bulges and two upward bulges arranged in an alternating manner along the transverse direction, and the downward bulges located on either transverse end are directly connected to corresponding parts of the side wall.

Since there is no planar part between the two opposing parts of the side wall, the advantages of the upward bulges and the downward bulges can be further enhanced.

The present invention thus provides an oil pan for an internal combustion engine that allows the bottom wall thereof to have an increased bending rigidity, does not impair the availability of the space immediately under the internal combustion engine, and does not unnecessarily increase the volume of the oil reservoir defined by the oil pan.

DESCRIPTION OF THE PREFERRED EMBODIMENT(S)

Figure 1:
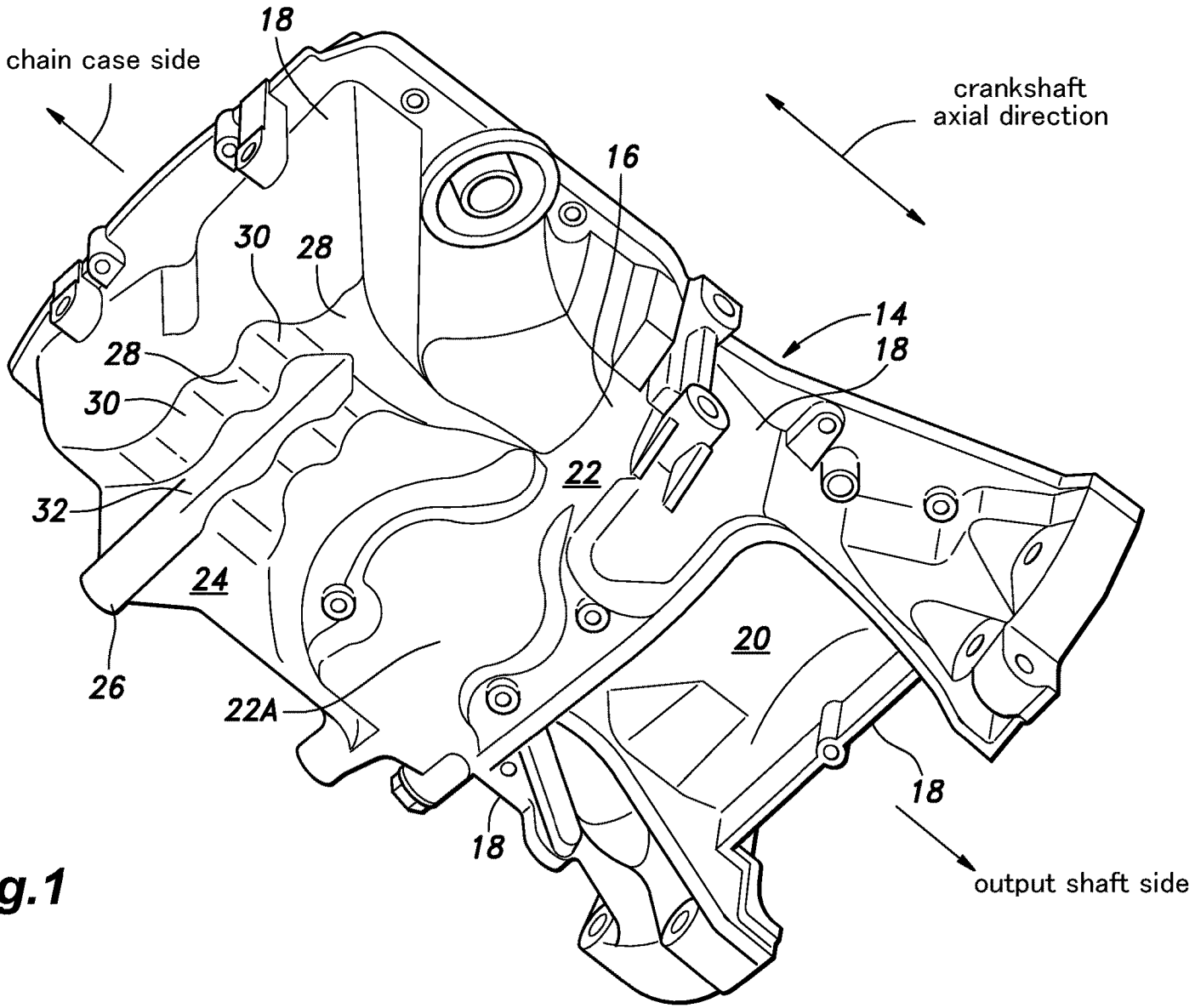
FIG. 1 is a perspective bottom view of an oil pan for an internal combustion engine according to an embodiment of the present invention.
Figure 2:
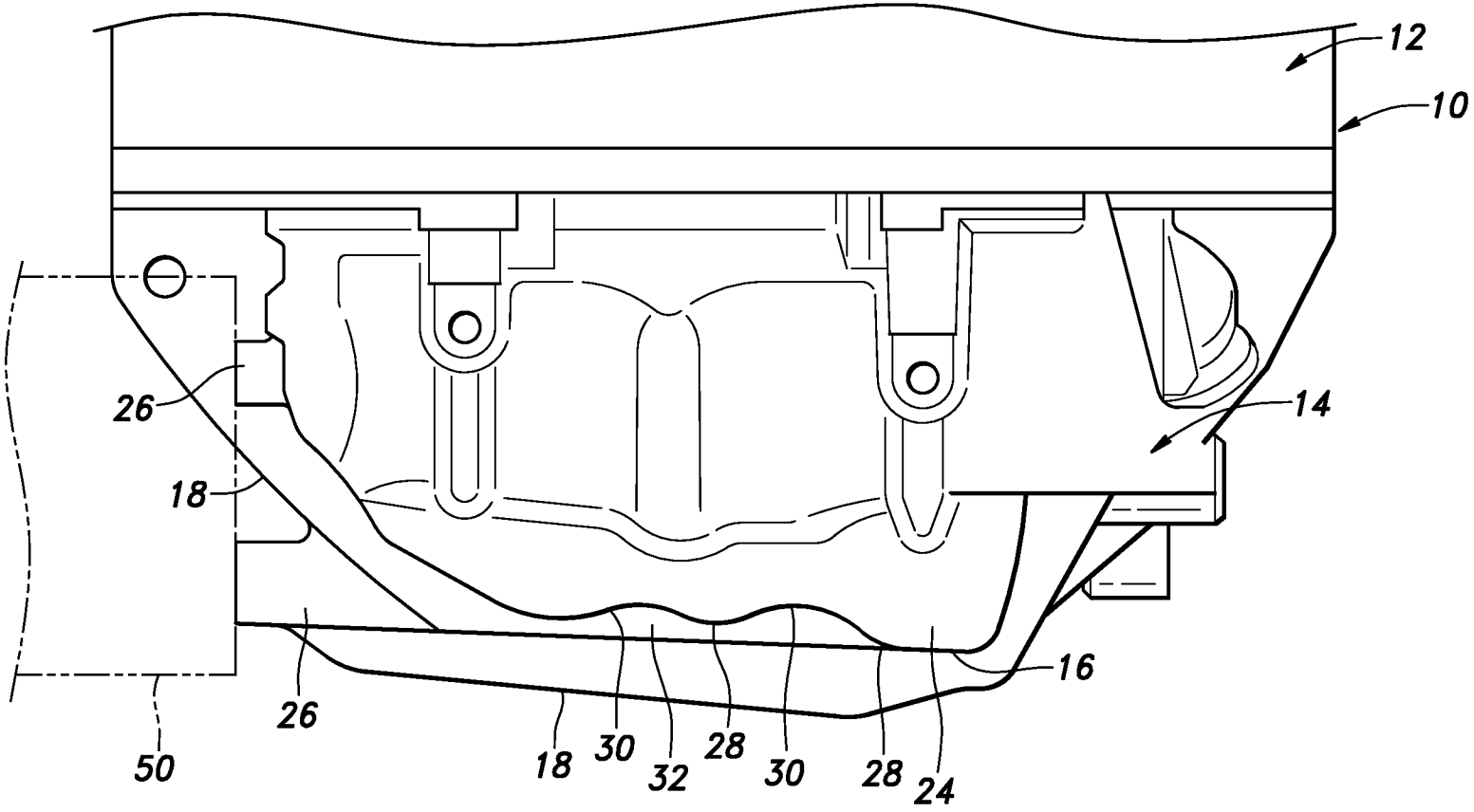
FIG. 2 is a front view of the oil pan.
Figure 3:
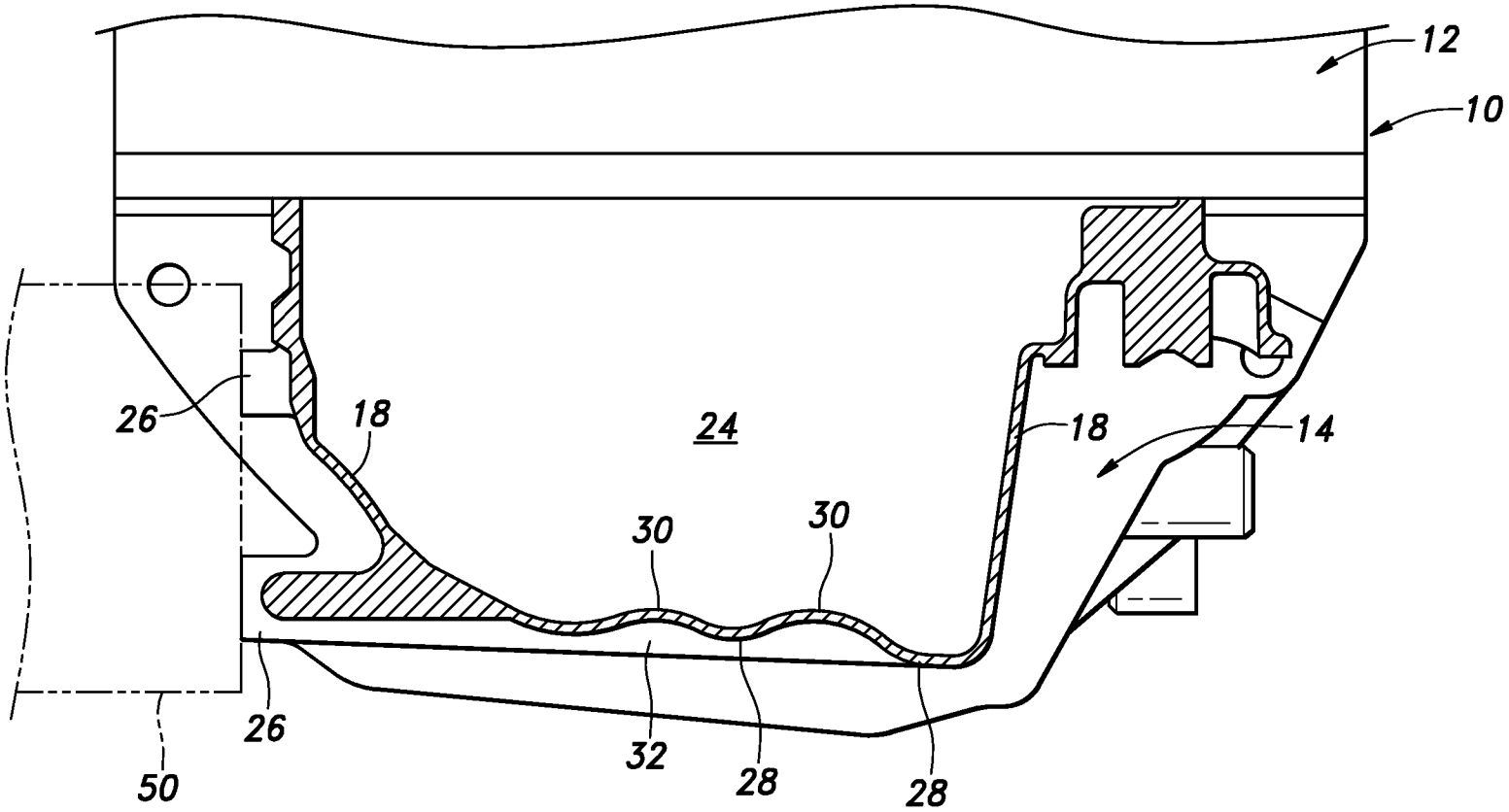
FIG. 3 is a cross sectional view of the oil pan including the intermediate depth portion.

An oil pan for an internal combustion engine according to an embodiment of the present invention is described in the following with reference to FIGS. 1 to 4.

The internal combustion engine 10 includes an engine block 12 (see FIGS. 2 and 3) that forms a main part of the engine, and an oil pan 14 attached to the lower end of the engine block 12. The axial direction of the crankshaft (not shown in the drawings) of the internal combustion engine 10, or the crankshaft axial direction X is indicated by arrow X in FIG. 1. The direction orthogonal to the crankshaft axial direction X (on a substantially horizontal plane) will be referred to as the "transverse" direction in the following disclosure.

The oil pan 14 includes a bottom wall 16 forming a bottom portion of the oil pan 14, and a side wall 18 extending upright from periphery of the bottom wall 16. The oil pan 14 is thus shaped as a box having an open top, and is attached to the engine block 12 at the upper end of the side wall 18. One end of the oil pan 14 along the crankshaft axial direction X will be referred to as the chain case side by being the end where a chain case (not shown in the drawings) is fitted, and the other end of the oil pan 14 along the crankshaft axial direction X will be referred to as the output shaft side by having an output shaft (not shown in the drawings) projecting therefrom.

The bottom wall 16 of the oil pan 14 includes a shallow bottom portion 20 located on the output shaft side, an intermediate depth portion 24 located on the chain case side, and a deep bottom portion 22 located between the shallow bottom portion 20 and the intermediate depth portion 24, and these three portions are arranged along the crankshaft axial direction X as three rectangular regions having a substantially same axial length. The intermediate depth portion is deeper than the shallow bottom portion, and shallower than the deep bottom portion.

The deep bottom portion 22 is provided with a substantially circular recess 22A that is recessed downward to place an oil strainer (not shown in the drawings) therein. The oil strainer is connected to an inlet port of an oil pump (also not shown in the drawings) to draw oil from the bottom of the oil pan 14 and distribute the oil to various parts of the engine.

A boss 26 extends transversely outward from a junction between the intermediate depth portion 24 and the side wall 18. The transversely outer end of the boss 26 is provided with a planar mounting surface for attaching an engine component part 50 thereto.

The intermediate depth portion 24 is provided with a wavy shape (corrugated shape) in cross section along a plane orthogonal to the crankshaft axial direction X, or more specifically, includes three downward bulges 28 and two upward bulges 30, each extending in the crankshaft axial direction X, arranged in an alternating manner along the transverse direction. The outer edges of the two outermost downward bulges 28 are smoothly connected to the adjoining parts of the side wall 18, respectively, without any intervening planar section of the bottom wall 16. The mutually adjoining parts of the downward bulges 28 and the upward bulges 30 are also smoothly connected to one another without any intervening planar section of the bottom wall 16.

As a result, the bending rigidity of the intermediate depth portion 24 in the crankshaft axial direction X is improved as compared with the case where the bottom wall 16 is substantially flat.

A reference line L is defined as a line which is tangential to both the outermost downward bulges 28 in the sectional view orthogonal to the crankshaft axial direction X, and no other part of the intermediate depth portion 24 is lower than this reference line L.

The downward bulges 28 and the upward bulges 30 extend substantially over the entire length of the intermediate depth portion 24 in the crankshaft axial direction X.

As a result, the bending rigidity of the bottom wall 16 in the crankshaft axial direction X is improved substantially over the entire length of the intermediate depth portion 24 in the crankshaft axial direction X.

Figure 4:
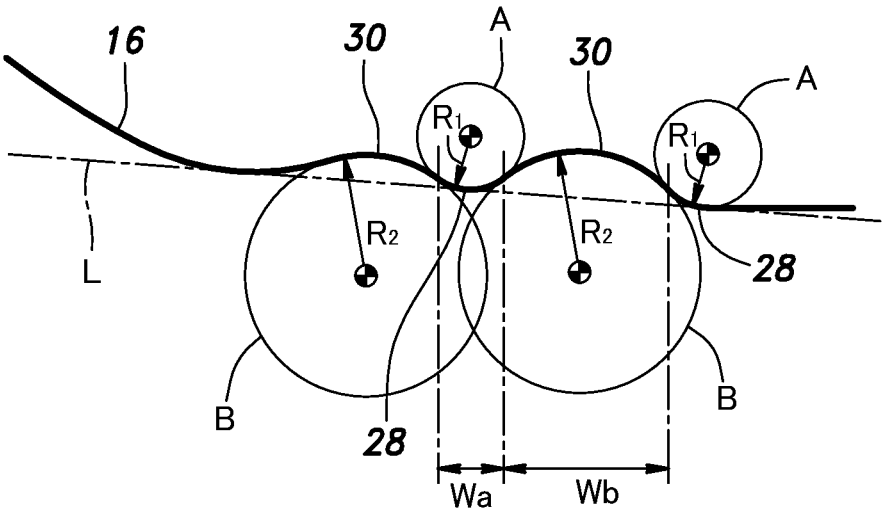
FIG. 4 is a diagram showing the geometry of the intermediate depth portion of the bottom wall of the oil pan.

As shown in FIG. 4, the two downward bulges 28 and the two upward bulges 30 on the transverse side remote from the boss 26 are defined by parts (arcs) of mutually externally tangent circles A and B having radii R1 and R2, respectively, in the section orthogonal to the crankshaft axial direction X. The radius of curvature of the upward bulges 30 is larger than the radius of curvature of the downward bulges 28. As a result, the width Wb of each upward bulge 30 in the transverse direction is larger than the width Wa of the downward bulges 28 in the transverse direction.

Thereby, as compared with the case where the width Wb of the upward bulges 30 and the width Wa of the downward bulges 28 are the same, the downward protrusion of the downward bulges 28 is minimized while the increase in the volume of the oil reservoir defined in the oil pan 14 due to the presence of the downward bulges 28 is minimized.

Furthermore, the bending rigidity of the bottom wall 16 in the crankshaft axial direction X is improved, the availability of the space immediately under the internal combustion engine is not impaired, and an unnecessary increase in the volume of the oil reservoir defined by the oil pan can be avoided.

In particular, since the downward bulges 28 and the upward bulges 30 are formed by arcs of mutually externally tangent circles A and B when viewed in the section orthogonal to the crankshaft axial direction X, and there is no planar section between the downward bulges 28 and the upward bulges 30, the bending rigidity of the bottom wall 16 in the crankshaft axial direction Xis effectively improved.

Further, the oil pan 14 further comprises a transverse rib 32 extending across the downward bulges 28 and the upward bulge 30 at intermediate parts thereof with respect to the crankshaft axial direction X, and bulging downward of the oil pan 14. The transverse rib 32 extends from the lowermost part of the downward bulge 28 located adjacent to a corresponding part of the side wall 18, and is connected to the boss 26 at the other end thereof. The boss 26 projects transversely outward from a junction between the corresponding part of the side wall 18, and the outermost end of the transverse rib 32.

As a result, the bending rigidity of the intermediate depth portion 24 in the transverse direction is improved. Since the transverse rib 32 is connected to the side wall 18 having a relatively high rigidity via the boss 26 (and the adjoining thick wall portion), the bending rigidity of the intermediate depth portion 24 in the transverse direction is particularly favorably increased by the transverse rib 32.

Although the present invention has been described in terms of a preferred embodiments thereof, it is obvious to a person skilled in the art that various alterations and modifications are possible without departing from the scope of the present invention which is set forth in the appended claims. For example, the numbers of the downward bulges 28 and the upward bulges 30 are not limited to those of the illustrated embodiment, and can be selected in other ways depending on each particular application. The shape of the cross section of the downward bulges 28 and the upward bulges 30 orthogonal to the crankshaft axial direction is not limited to be based on circles (true circles), but may also be based on other curved shapes such as ellipses or the like.

The invention claimed is:

1. An oil pan provided in a lower part of an internal combustion engine, and including a bottom wall, wherein the bottom wall includes two downward bulges extending in a crankshaft axial direction, and an upward bulge positioned between the two downward bulges continuously to the downward bulges and extending in the crankshaft axial direction, the upward bulge having a width as measured in a transverse direction orthogonal to the crankshaft axial direction greater than corresponding widths of the downward bulges, wherein the downward bulges and the upward bulge each define an arcuate shape in a section orthogonal to the crankshaft axial direction, and the upward bulge has a larger radius of curvature than the downward bulges, wherein the bottom wall includes a shallow bottom portion located on an output shaft end thereof, an intermediate depth portion located on a chain case side thereof, and a deep bottom portion located between the shallow bottom portion and the intermediate depth portion along the crankshaft axial direction, the intermediate depth portion being deeper than the shallow bottom portion and shallower than the deep bottom portion, and the downward bulges and the upward bulge are provided in the intermediate depth portion, and wherein the downward bulges and the upward bulge extend substantially over an entire length of the intermediate depth portion in the crankshaft axial direction.

2. The oil pan according to claim 1, wherein the downward bulges and the upward bulge are defined by parts of mutually externally tangent circles in the section orthogonal to the crankshaft axial direction.

3. The oil pan according to claim 1, further comprising a transverse rib extending across the downward bulges and the upward bulge at intermediate parts thereof with respect to the crankshaft axial direction, the transverse rib bulging downward of the oil pan.

4. The oil pan according to claim 1, further comprising a side wall extending upright from a peripheral edge of the bottom wall, and a boss projecting from a junction between an outer end of the transverse rib and the side wall in the transverse direction, an outer end of the boss being configured to attach an engine component part.

5. The oil pan according to claim 1, further comprising a side wall extending upright from a peripheral edge of the bottom wall, wherein the bottom wall includes three downward bulges and two upward bulges arranged in an alternating manner along the transverse direction, and the downward bulges located on either transverse end are directly connected to corresponding parts of the side wall.

6. An oil pan provided in a lower part of an internal combustion engine, and including a bottom wall, wherein the bottom wall includes two downward bulges extending in a crankshaft axial direction, and an upward bulge positioned between the two downward bulges continuously to the downward bulges and extending in the crankshaft axial direction, the upward bulge having a width as measured in a transverse direction orthogonal to the crankshaft axial direction greater than corresponding widths of the downward bulges, wherein the downward bulges and the upward bulge each define an arcuate shape in a section orthogonal to the crankshaft axial direction, and the upward bulge has a larger radius of curvature than the downward bulges, wherein the downward bulges and the upward bulge are defined by parts of mutually externally tangent circles in the section orthogonal to the crankshaft axial direction, further comprising a transverse rib extending across the downward bulges and the upward bulge at intermediate parts thereof with respect to the crankshaft axial direction, the transverse rib bulging downward of the oil pan, and further comprising a side wall extending upright from a peripheral edge of the bottom wall, and a boss projecting from a junction between an outer end of the transverse rib and the side wall in the transverse direction, an outer end of the boss being configured to attach an engine component part.

7. The oil pan according to claim 6, wherein the bottom wall includes a shallow bottom portion located on an output shaft end thereof, an intermediate depth portion located on a chain case side thereof, and a deep bottom portion located between the shallow bottom portion and the intermediate depth portion along the crankshaft axial direction, the intermediate depth portion being deeper than the shallow bottom portion and shallower than the deep bottom portion, and the downward bulges and the upward bulge are provided in the intermediate depth portion.

8. The oil pan according to claim 7, wherein the downward bulges and the upward bulge extend substantially over an entire length of the intermediate depth portion in the crankshaft axial direction.

9. The oil pan according to claim 6, further comprising a side wall extending upright from a peripheral edge of the bottom wall, wherein the bottom wall includes three downward bulges and two upward bulges arranged in an alternating manner along the transverse direction, and the downward bulges located on either transverse end are directly connected to corresponding parts of the side wall.

* * * * *